US005530987A

United States Patent [19]

Piccirillo et al.

[11] Patent Number: 5,530,987

[45] Date of Patent: Jul. 2, 1996

[54] CONDENSATE DRAIN CONTROLLER

[75] Inventors: David P. Piccirillo, Carroll; John T. Huston, Lancaster, both of Ohio

[73] Assignee: The Babcock & Wilcox Company, New Orleans, La.

[21] Appl. No.: 919,471

[22] Filed: Jul. 24, 1992

[51] Int. Cl.[6] ..... A47L 25/00

[52] U.S. Cl. ..... 15/319; 15/316.1; 236/91 F; 137/204

[58] Field of Search ..... 15/316.1, 317, 15/319, 318.1, 406, 407; 236/52, 54, 56, 59, 91 F; 137/203, 204; 364/509, 510; 374/147, 148

[56] References Cited

U.S. PATENT DOCUMENTS

| | | | |
|---|---|---|---|
| 3,112,880 | 12/1963 | Pollock | 236/91 F |
| 4,197,990 | 4/1980 | Carberg | 236/56 |
| 4,261,382 | 4/1981 | Bridges | 137/204 |
| 4,445,636 | 5/1984 | Peters | 236/91 F |
| 4,498,427 | 2/1985 | Todd | 15/316.1 |
| 4,875,623 | 10/1989 | Garris | 364/510 |
| 5,006,867 | 4/1991 | Koizumi | 374/147 |
| 5,172,560 | 12/1992 | Jurewicz | 236/91 F |

FOREIGN PATENT DOCUMENTS

| | | | |
|---|---|---|---|
| 49420 | 3/1984 | Japan | 15/316.1 |
| 165516 | 7/1986 | Japan | 15/316.1 |
| 153621 | 7/1987 | Japan | 15/316.1 |
| 91417 | 4/1988 | Japan | 15/316.1 |
| 244209 | 9/1989 | Japan | 15/316.1 |

*Primary Examiner*—David Scherbel
*Assistant Examiner*—Terrence R. Till
*Attorney, Agent, or Firm*—Robert J. Edwards; Eric Marich

[57] ABSTRACT

A system for automatically controlling a drain valve connected to a sootblower steam piping system utilizes two temperature measurements, one near the steam source and the other near the drain valve. Comparison of the difference in steam temperature between these two locations with an adjustable temperature setpoint allows the drain valve to be opened to drain condensate and maintain minimum allowable superheat over a wide range of conditions. The system allows the temperature sensing to "float" with steam source conditions, since it is continuously adjusted to compensate for steam source temperature and ambient temperature changes.

2 Claims, 8 Drawing Sheets

CLOSED : ΔT < Tsp
OPEN : ΔT ≥ Tsp

CLOSED : ΔT < Tsp
OPEN : ΔT ≥ Tsp

HIGH SH SOURCE

NORMAL CONDITIONS $T_S$ = 786° F
SH = 300° F

THERMAL DRAIN/WELL

755° F = THERMAL WELL MAX. TEMP. = 659° F

HIGH TEMP. SETTING=730°F
LOW TEMP. SETTING=680°F
DRAIN OPENS AT 680°F
MAINTAINS 194°F SH

INVENTION

T1 = 770° F
T2 = 755° F
T1 - T2 = 15°F

SET $T_{msh}$ = 30° F

DRAIN OPENS WHEN
T1 = 755°F & T2 = 725°F
MAINTAINS 239°F SH

LOW SH CONDITIONS (FOULED SUPERHEATER)

$T_S$ = 686°F
SH = 200°F

LOW SETTING > $T_{max}$
DRAIN OPEN CONTINUOUSLY,
SOOTBLOWERS CAN'T CLEAN
FOULED SUPERHEATER

T1 = 672°F
T2 = 659°F
T1 - T2 = 13°F

DRAIN OPENS WHEN
T1 = 655°F & T2 = 625°F
MAINTAINS 139°F SH

LOW SH SOURCE

600 PSI @ 570° F $T_S$ = 570°F
SH = 84°F

THERMAL DRAIN/WELL

THERMAL WELL MAX. TEMP. = 547°F
HIGH TEMP. SETTING=522° F
LOW TEMP. SETTING=472°F
$T_{sat}$ = 486°F
LOW SETTING < $T_{sat}$, DRAIN CAN'T OPEN UNTIL CONDENSATE BUILDS UP AND COOLS

INVENTION

T1 = 559°F
T2 = 547°F
$T_{msh}$ = 25°F

DRAIN OPEN WHEN T1 = 546°F & T2 = 521°F
MAINTAINS 35°F SH

FIG.6 CONT.

CONDENSATE DRAIN CONTROLLER

BACKGROUND OF THE INVENTION

1. Field of the Invention

The present invention relates generally to the field of condensate drain equipment for steam header/piping systems and, more particularly, to a system and method for automatically draining condensate from steam sootblower header/piping systems for fossil-fueled steam generators used in electric power generation.

A fossil-fueled steam generator utilizes the stored chemical energy contained within the remains of fossil vegetation as the source of heat. Combustion of the fossil fuel releases this stored chemical energy which, in turn, is used to heat water and generate steam. By expanding the steam through a turbine connected to a generator, the energy in the steam is converted to electricity.

The combustion process generates hot combustion gases and, in most instances, residues known as "ash". The transfer of heat to the water/steam is accomplished by passing the hot combustion gases across banks of tubes known as heating surface, and through which the water/steam flows. The heating surface can be water cooled, superheater or reheater surface, depending on the fluid flowing therethrough. Continuous operation of the steam generator causes ash deposits or soot to build up on the tubes, decreasing the heat transfer efficiency. The deposits must be removed to restore the thermal efficiency and this removal is accomplished through the use of sootblowers. A sootblower directs a jet of high pressure media against the tube surface to dislodge the accumulated ash deposits and clean the heating surface. The sootblowers generally employ saturated or superheated steam as the blowing media. The sootblower steam source is generally the steam generator itself, and thus the operation of the heat transfer process in the steam generator has a direct effect upon the temperature and pressure of the steam for the sootblowers.

As would be expected, various areas of the steam generator's heat transfer surfaces have different cleaning requirements. The type of deposit and heating surface being cleaned determines the frequency and duration of a sootblower cleaning cycle, as well as the performance requirements of the sootblowing steam. Due to the nature and size of the steam generators themselves, and their arrangement of heat transfer surfaces located in the path of the combustion gases, elaborate steam header/piping systems are required to transport the steam from a given source in the steam generator (for example, a header connected to a bank of superheater or reheater heat transfer surface) to a given sootblower, while still providing the proper steam temperature and pressure to the sootblower to adequately clean the tubes during a cleaning cycle.

2. Description of the Related Art

The aforementioned steam header/piping systems require some means of warm-up to ensure that the proper degree of superheat is maintained and to rid the system of condensate before initiating a sootblowing cycle. This is usually accomplished by blowdown, using steam to purge and heat the sootblower piping. In the past, various methods and apparatus have been used to accomplish blowdown. Very early approaches were simple, manually operated, orificed drain valves. Later approaches incorporated automatic float and thermally operated traps. The present state of the art also includes thermally controlled, air operated drain valves; i.e., the thermal drain. FIGS. 1A, 1B and 1C show the aforementioned methods in their simplest form. FIG. 1A shows the use of the manual orifice, while FIG. 1B shows the use of a steam trap. Both of these approaches can be used where the sootblowing media is either saturated steam or superheated steam. FIG. 1C shows the use of the thermal drain to eliminate condensate from a piping system. Generally the thermal drain has a HI and LO temperature setpoint, at which the valve closes or opens, respectively, with a 50° F. temperature differential therebetween. The thermal drain is thus generally used only with superheated, and not saturated steam, because the difference in temperature between hot condensate and saturated steam at a given pressure is practically nil. All of these blowdown methods are still in common use today. The thermal drain and trap have both evolved into sophisticated complex units in an attempt to improve operating reliability.

As used herein, the terms "saturated steam" and "superheated steam" are used in their ordinary thermodynamic context as known to those skilled in the art. The term "saturation temperature" designates the temperature at which vaporization takes place at a given pressure, and this pressure is called the "saturation pressure" for the given temperature. Thus, for water at 212° F., the saturation pressure is 14.7 psia, and for water at 14.7 psia the saturation temperature is 212° F. If a substance exists as a liquid at the saturation temperature and pressure, it is called saturated liquid. If a substance exists as a vapor at the saturation temperature, it is called saturated vapor, and if water is the substance, it is called "saturated steam". Similarly, when the vapor is at a temperature greater than the saturation temperature, it is said to exist as superheated vapor, and if water is the substance, it is called "superheated steam". For further details, the reader is referred to *Fundamentals of Classical Thermodynamics,* Second Edition, Van Wylen and Sonntag, John Wiley and Sons, Inc., 1973.

There are problems with the use of traps and thermal drains. While the steam generators have a full load maximum steaming capacity in pounds per hour of steam at a required temperature and pressure, the steam generator often operates at lower loads. The rate of heat transfer between the combustion gases and the water/steam flowing through the heat transfer surfaces changes with boiler load. A point which produced steam at a certain temperature and pressure at maximum load will produce steam at a different temperature and pressure at lower loads, and yet the sootblowing steam media requirements to clean a bank of heating surface remain the same. Variations in fuel quality can also change the combustion process and heat transfer distribution that results, as well as affecting the cleanliness of individual banks of heat transfer surface within the steam generator. Further, seasonal ambient variations in temperature can also affect the steam generator's performance. As mentioned earlier, thermal drains will not work with saturated steam. Steam traps can easily stick open and/or closed due to the low actuating force derived from the controlled media.

FIG. 2 is a schematic of a typical prior art system. As shown, this system uses a single thermal sensor located near the drain, such as a thermal well or thermostatic trap, to provide a signal that is compared to a manually adjustable setpoint for drain valve control. In such systems, the drain valve is opened to drain condensate when the steam temperature (T1) is less than the setpoint temperature ($T_{MIN}$). The drain valve is closed when T1 is greater than or equal to the minimum allowable normal operating temperature ($T_{NORM}$). $T_{NORM}$ is defined as:

$$T_{NORM}=T_{MIN}+T_{DIFF}$$

where $T_{DIFF}$ is a margin or setpoint differential added to the setpoint temperature, $T_{MIN}$. Between $T_{NORM}$ and $T_{MIN}$ is a "deadband" where the drain valve will retain its position (open or closed) until $T_{NORM}$ or $T_{MIN}$ is reached.

In some cases, however, the source steam temperature ($T_{SOURCE}$) varies more than the setpoint differential, $T_{DIFF}$. This condition renders the thermal controller useless until it is readjusted, leaving the drain valve continually open (dumping steam) or continuously closed (resulting in loss of superheat and/or condensate buildup). Changes in ambient temperature can also cause thermal sensor response errors greater than $T_{DIFF}$, leading to the same problem.

Accordingly, it has become desirable to develop an improved condensate drain controller which overcomes the problems of the prior art.

SUMMARY OF THE INVENTION

The present invention utilizes two temperature sensors, one located near the steam source and the other located near the drain. Signals provided by each of these sensors are provided to a summing amplifier unit which calculates the difference in steam temperature between the temperatures measured by these two sensors. This difference is then compared to a temperature setpoint signal which is selected to provide the minimum allowable difference in steam temperature between the steam temperature at the source and the steam temperature at the drain valve (i.e., the degree of superheat) for the worst case steam source conditions. A drain valve control signal is produced, based upon a comparison of this difference in steam temperature with the temperature setpoint signal. When this difference in steam temperature is greater than or equal to the temperature setpoint signal, the drain valve control signal causes the drain valve to open, warming the header while removing any condensate. When this difference in steam temperature is less than the temperature setpoint signal, the header has been sufficiently warmed and the drain valve control signal causes the drain valve to close.

A plurality of temperature sensors can be used on large complex header/piping systems (i.e., one sensor for measuring the source steam temperature supplying several sootblowers, and several sensors, each located near a plurality of drains to measure the temperature at each drain). If desired, modulating type drain valves can be employed, and the drain valve control signal can be used as an analog input to proportionally control the drain valves' position, and thus the flow of condensate through the drain valves.

The various features of novelty which characterize the invention are pointed out with particularly in the claims annexed to and forming a part of this disclosure. For a better understanding of the present invention and the advantages attained by its use, reference is made to the accompanying drawings and descriptive matter in which a preferred embodiment of the invention is illustrated.

DESCRIPTION OF THE PREFERRED EMBODIMENTS

Figure 1A:
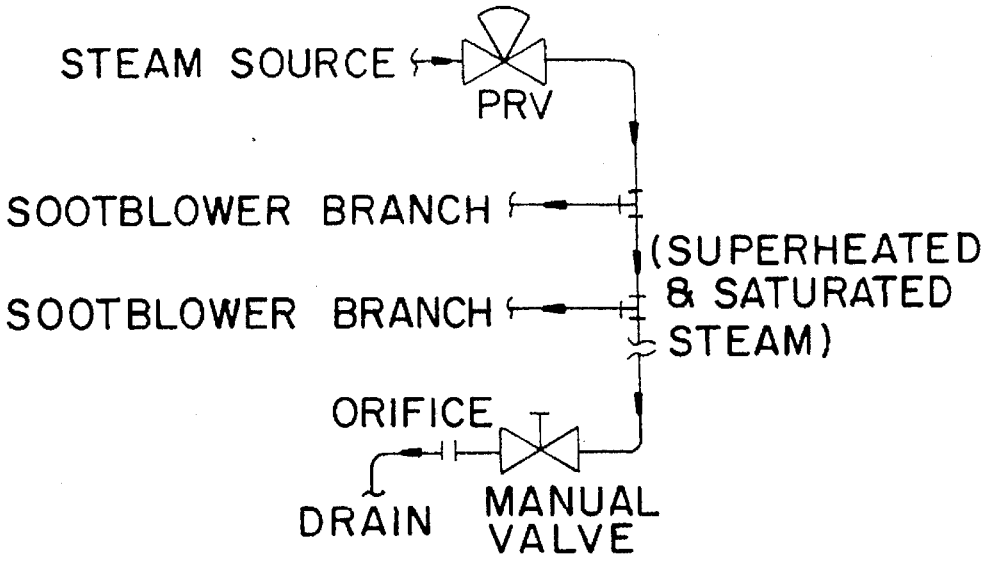
FIG. 1A PRIOR ART
FIGS. 1A, 1B and 1C are schematics showing, respectively, the manual orifice, steam trap and thermal drain arrangements of the prior art.
Figure 1B:
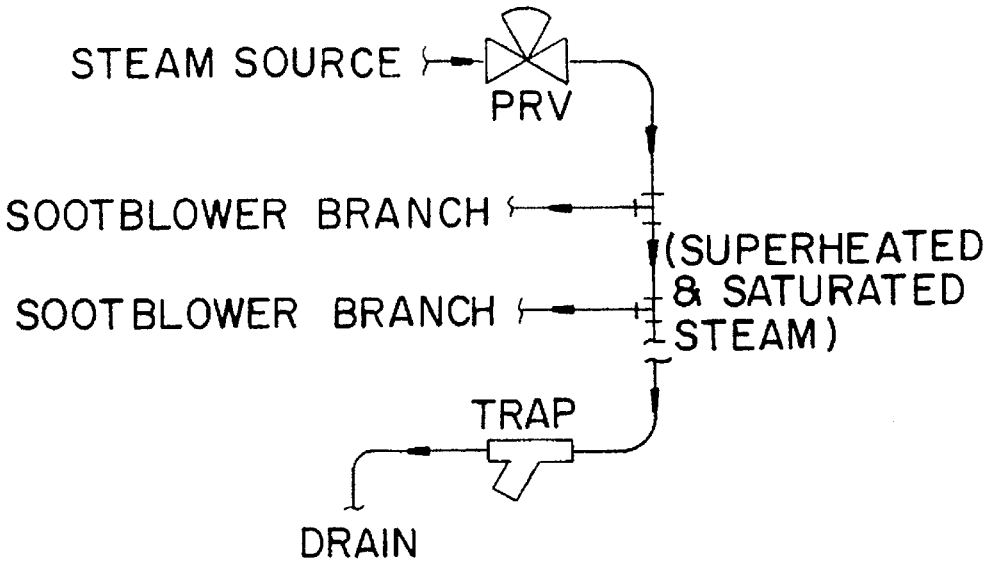
FIG. 1B PRIOR ART
Figure 1C:
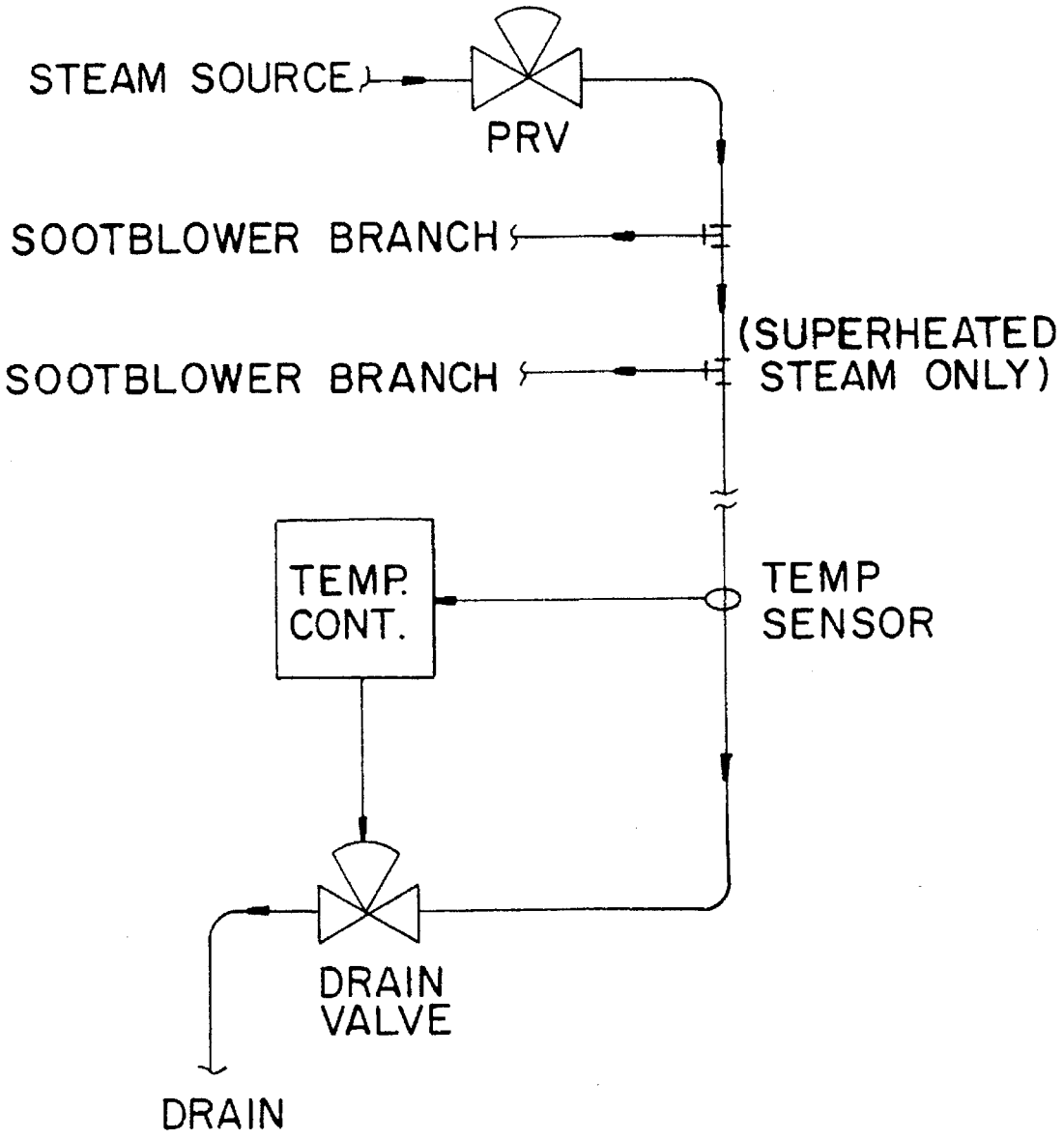
FIG. 1C PRIOR ART
Figure 2:
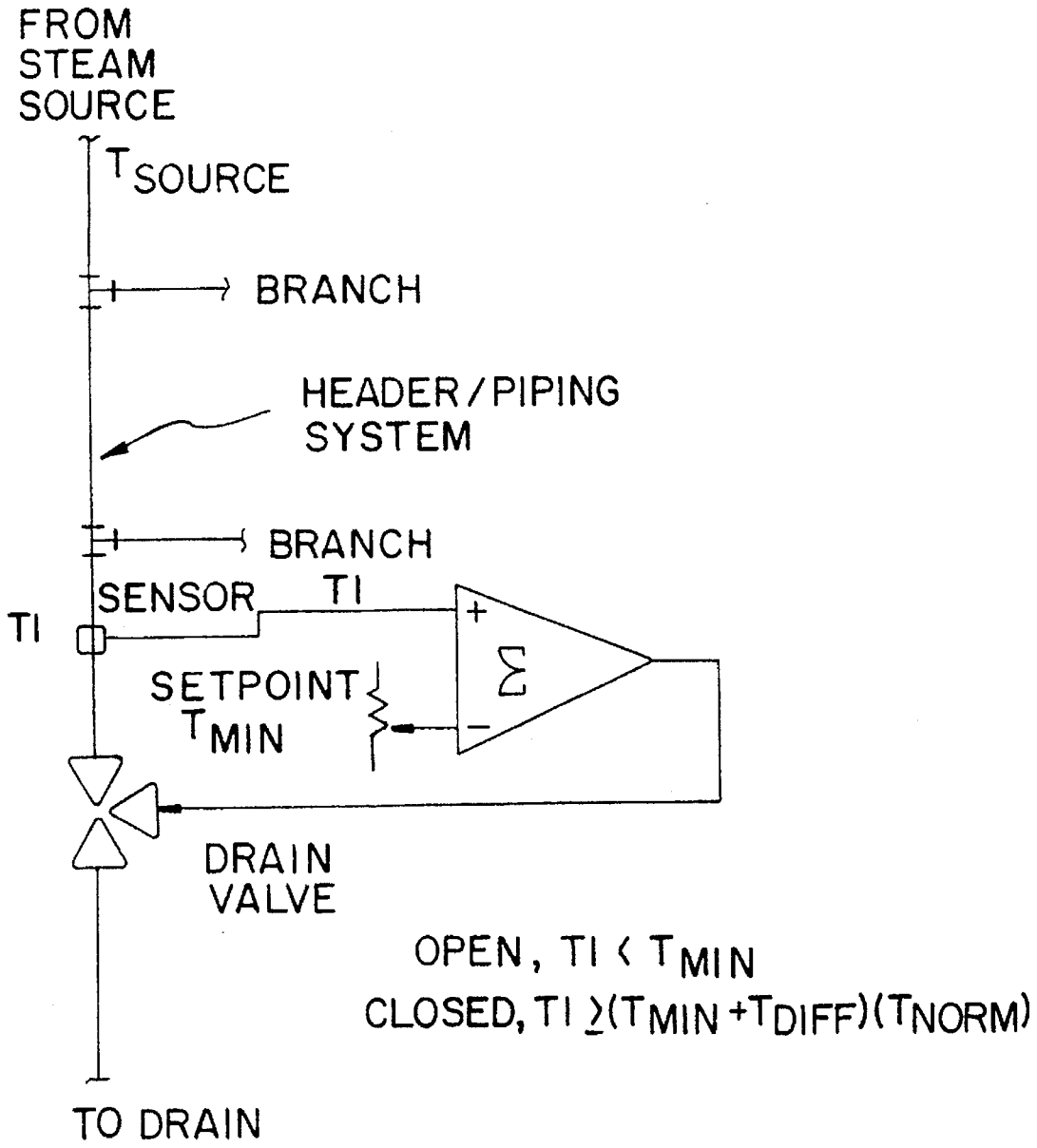
FIG. 2 PRIOR ART
FIG. 2 is a schematic of a typical single thermal sensor/thermal well system of the prior art.
Figure 3:
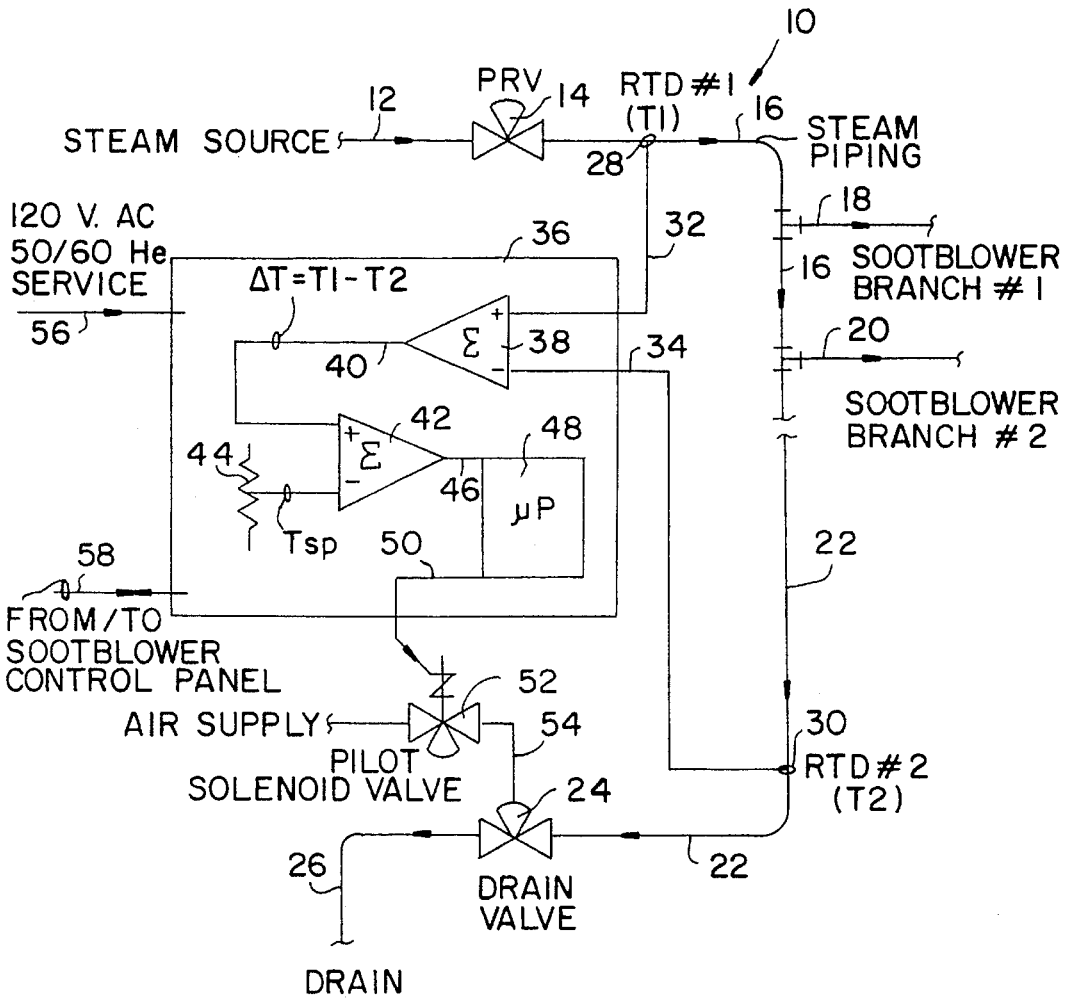
FIG. 3 is a simplified schematic of the present invention, as applied to a sootblower steam piping system, utilizing two temperature sensors.

Referring to the drawings generally, wherein like numerals designate the same element throughout the several drawings, and to FIG. 3 in particular, there is shown a portion of a sootblower steam piping system, generally referred to as 10, of a type typically employed on a fossil-fueled steam generator (not shown) which will supply the steam for the sootblowers. The pressure part design of the sootblower steam piping system 10 would be performed according to known applicable boiler and piping codes and, as such, is beyond the scope of the present invention. The steam for the sootblower steam piping system 10 is conveyed from a steam source in the steam generator, typically a header connected to a bank of superheater or reheater surface, by means of piping 12 to a pressure reducing valve (PRV) 14. The PRV 14 is required because the sootblower steam pressure requirements are generally much lower than the available pressure at the steam source. The PRV 14 is used to reduce the steam pressure to the level required by the sootblowers. The steam is conveyed from the PRV 14 by means of piping 16 to various sootblower branch lines that supply steam to the individual sootblowers. Only two such sootblower branch lines 18, 20 have been shown; it is understood that more branch lines could be supplied by a given steam source. Drain piping 22 is provided after the last or lowest sootblower branch line (shown here as branch line 20), to a drain valve 24 the outlet of which is connected to drain valve outlet piping 26.

First temperature sensing means 28 are provided on the piping 16, just downstream of the PRV 14 and as close as is practical to the steam source, to produce a first signal representative of the steam temperature at the source. Second temperature sensing means 30 are provided on the drain piping 22 as close as practical to the drain valve 24, to produce a second signal representative of the steam temperature at the drain valve 24. Advantageously, each of the temperature sensing means 28, 30 is a resistance temperature detector (RTD) selected so that its range will encompass the normally expected steam temperature range within its associated piping. The main feature required of the first and second temperature sensing means 28, 30 is that each must be capable of producing a signal representative of the steam temperature that varies in substantially linear fashion with the actual steam temperature.

The first and second temperature sensing means 28, 30 provide their signals along lines 32, 34, respectively, to a microprocessor based control unit 36. A first summing amplifier unit 38 receives at the positive input thereof the first signal representative of the steam temperature at the source; the second signal representative of the steam temperature at the drain valve 24 is provided to the negative input of the first summing amplifier unit 38. First summing amplifier unit 38 produces a signal representative of the difference in steam temperature between the source and drain, $\Delta T = T1 - T2$, at the output thereof which is transmitted along line 40 to a positive input of a second summing amplifier unit 42. Potentiometer (P) 44 is used to provide a variable setpoint temperature $T_{SP}$ at the negative input of the second summing amplifier unit 42. This second summing amplifier unit 42 produces a signal based upon a comparison of the setpoint temperature $T_{SP}$ and $\Delta T$ as shown. This signal is transmitted along line 46 to an arrangement of microprocessors and associated electronic circuitry, generally referred to as 48, which produces a drain valve control signal that is outputted along line 50 to open or close the drain valve 24. The drain valve control signal is operative to close the drain valve 24 when $\Delta T$ is less than $T_{SP}$ and to open the drain valve 24 when $\Delta T$ is greater than or equal to $T_{SP}$. The drain valve control signal is used to operate means for controlling the drain valve 24, advantageously an air operated pilot solenoid valve 52, connected to an external pneumatic air supply, and to control the drain valve 24 via line 54.

The power supply for the microprocessor based control unit 36 is conventional single phase, 120 volt AC 50/60 Hz, provided over a power supply line 56. Additionally, the microprocessor based control unit 36 can be interconnected with existing sootblower control panel(s) (not shown), provided for the sootblowers on a given steam generator, via line or lines 58. Thus, the entire operation of sootblower initiation, and the preheating and draining of condensate can be automatically controlled. This is not a necessity, however, and the system of the present invention can be used to control draining of condensate and/or preheating of the steam piping independently of the sootblower controls.

Figure 4:
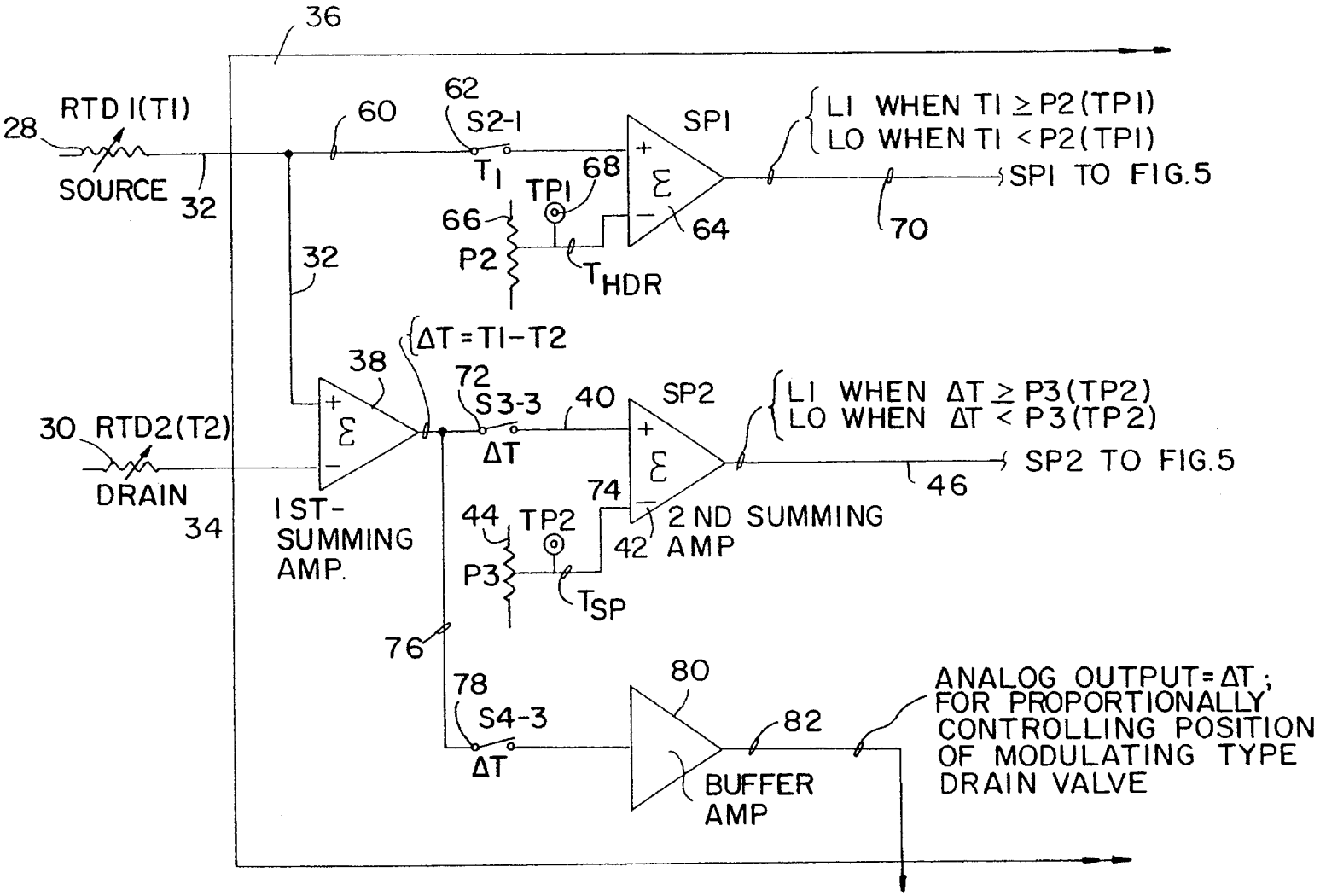
FIGS. 4 and 5 are block diagram schematics of the invention.

Referring now to FIG. 4, there is shown a block diagram schematic of a portion of the microprocessor based control unit 36. The first temperature sensing means 28 produces a first signal representative of the steam temperature at the source which is supplied along line 32 to the positive input of the first summing amplifier unit 38. Line 60, connected to line 32, also provides the first signal representative of the steam temperature at the source to dipswitch 62 connected to the positive input of a third summing amplifier unit 64. Potentiometer 66 is used to provide a variable setpoint temperature $T_{HDR}$ at the negative input of the third summing amplifier unit 64. Connector terminal 68 is provided on a line connecting potentiometer 66 with the third summing amplifier unit 64 to allow for calibration and setting of the setpoint temperature $T_{HDR}$. The setpoint temperature $T_{HDR}$ is indicative of whether or not the steam piping connected to the source is energized, i.e., carrying steam. If the temperature sensed by the first temperature sensing means 28 is greater than or equal to the setpoint temperature $T_{HDR}$ as represented by the setting of potentiometer 66, the output signal of the third summing amplifier unit 64 will be a logical 1 value. However, if the temperature sensed by the first temperature sensing means 28 is less than the setpoint header temperature $T_{HDR}$, the output signal of the third summing amplifier unit 64 will be a logical 0 valve. These logical 1 and logical 0 signals are output along a line 70 and utilized by specific elements of the system as disclosed later in this detailed description.

The second temperature sensing means 30 produces a second signal representative of the steam temperature at the drain valve 24 along line 34 to the negative input of the first summing amplifier unit 38. At the output of the first summing amplifier 38, there is produced the signal representative of the difference in steam temperature between the source and drain, $\Delta T=T1-T2$,which is transmitted along line 40 through a dipswitch 72 to the positive input of the second summing amplifier unit 42. The potentiometer 44 is used to provide a variable setpoint temperature $T_{SP}$ to the negative input of the second summing amplifier unit 42. Connector terminal 74 is provided on a line connecting potentiometer 44 with the second summing amplifier unit 42 to allow for calibration and setting of the setpoint temperature $T_{SP}$. The output signal of the second summing amplifier unit 42 is provided over line 46 and has a logical 1 valve when the $\Delta T$ is greater than or equal to the setpoint temperature $T_{SP}$ or a logical 0 valve when the $\Delta T$ is less than the setpoint temperature $T_{SP}$. These logical 1 and logical 0 signals from the second summing amplifier unit 42 are utilized by specific elements of the system as disclosed later in this detailed description.

The system of the present invention can be used to proportionally control the position of a modulating type of drain valve 24. For this purpose, line 76 is connected to line 40 for providing the signal representative of the difference in steam temperature between the source and drain, $\Delta T$, through a dipswitch 78 to buffer amplifier unit 80. The output of the buffer amplifier unit 80 is provided along a line 82 and is an analog output proportional to the $\Delta T$, and which would be used to proportionally control the position of a modulating type of drain valve 24.

Figure 5:
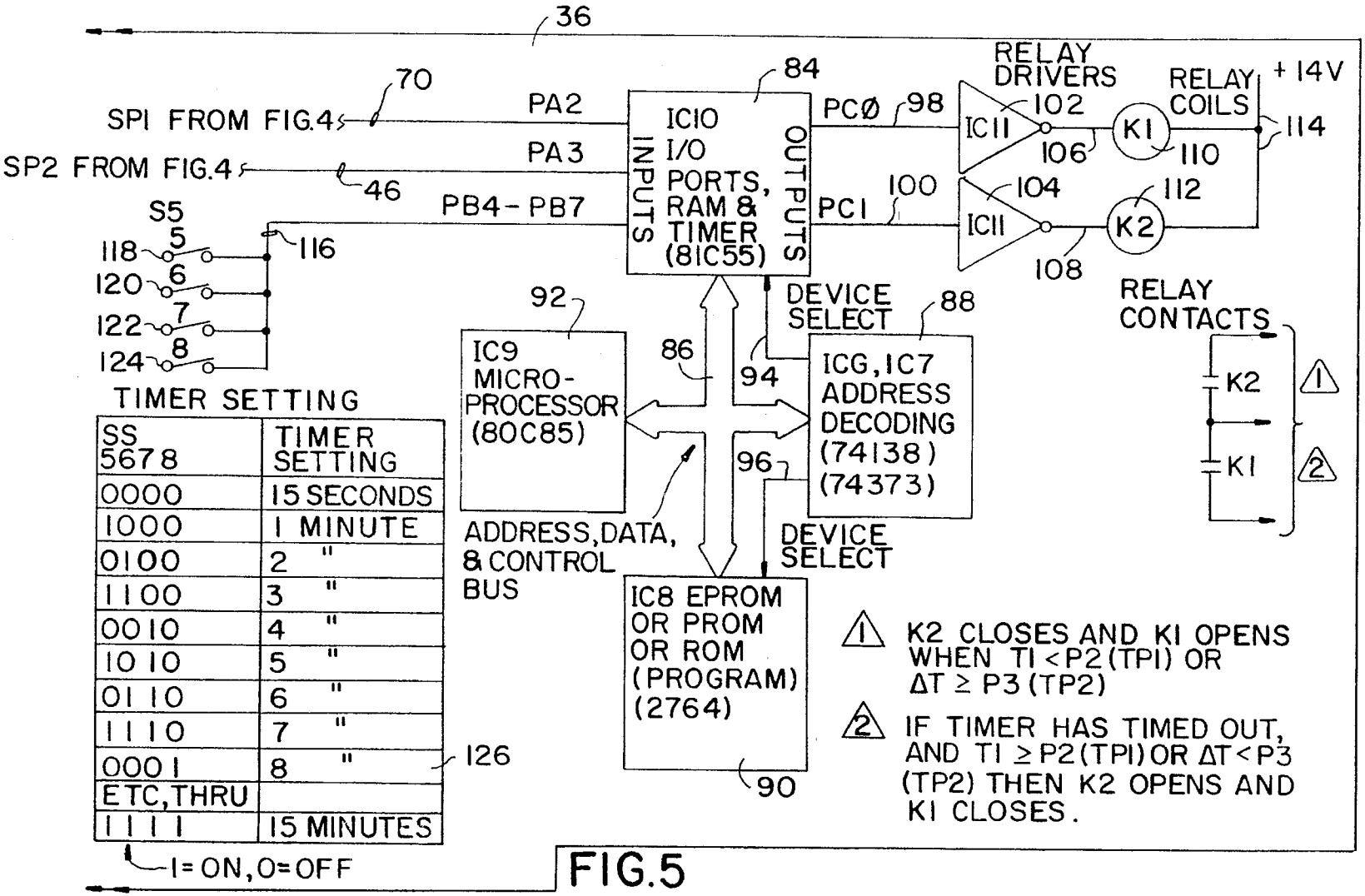
Figure 6:
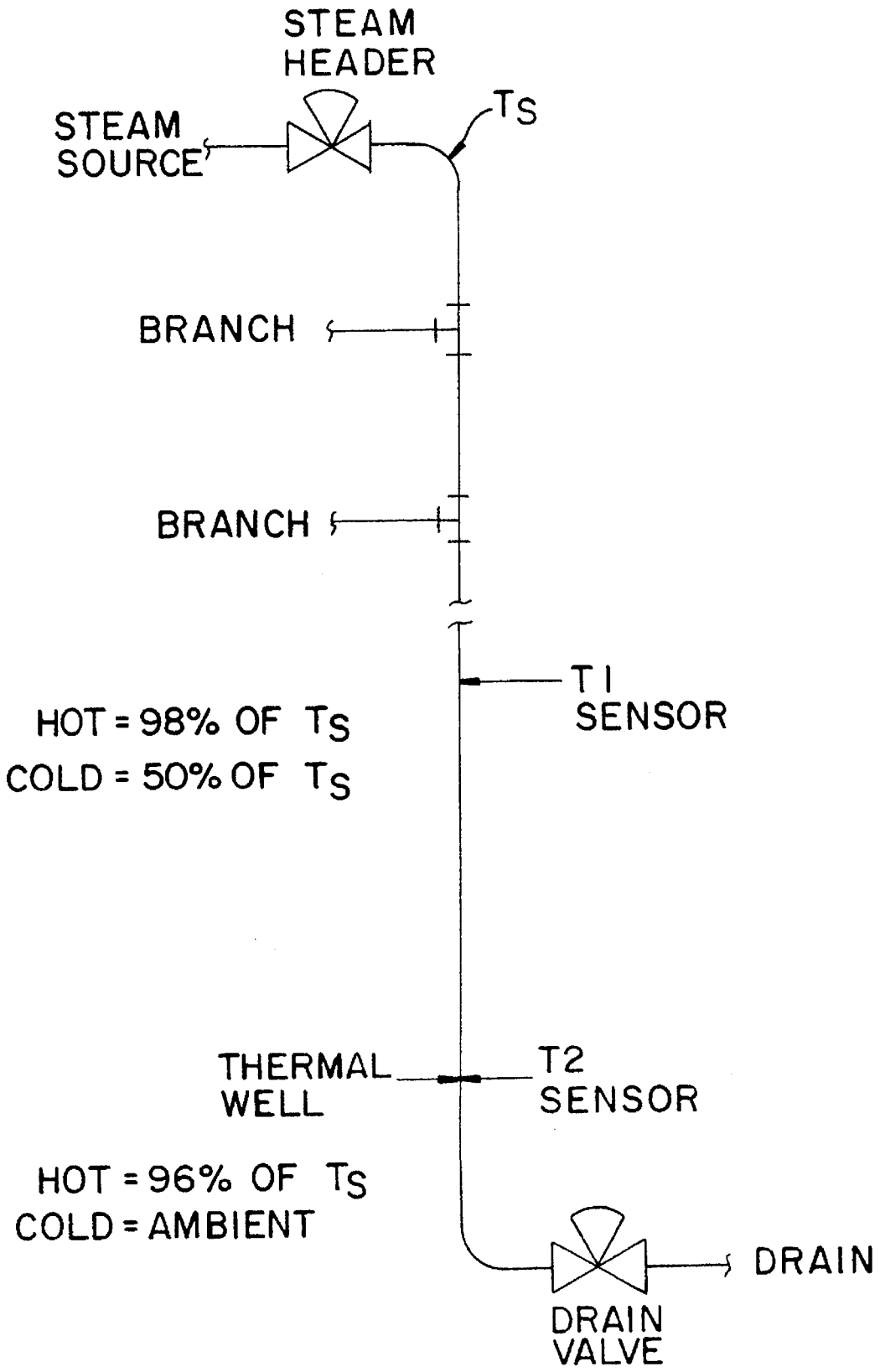
FIG. 6 is a diagram comparing the operation of the prior art thermal well/drain with the condensate drain controller of the invention at various operating conditions.

Referring now to FIG. 5, there is shown a continuation of the block diagram set forth in FIG. 4. Lines 70 and 46 are connected to the input side of an input/output (I/O) port, Random Access Memory (RAM) and timer unit 84, advantageously an INTEL 81C55 integrated circuit. Unit 84 interfaces along address, data, and control bus 86 with address decoding modules 88, advantageously a MOTOROLA 74HCT138 and 74HC373 integrated circuits, EPROM, PROM or ROM program module 90, advantageously a NATIONAL 2764 EPROM, and microprocessor unit 92, advantageously a OKI 80C85 integrated circuit. Bus 86 allows the aforementioned unit 84 to communicate and transfer data between itself and units 88, 90 and 92. Additionally, by means of lines 94 and 96, the address decoding modules 88 can select the appropriate device to be controlled. Lines 98 and 100 are connected to the output side of the unit 84 and to relay drivers 102, 104, respectively. The relay drivers 102, 104 are advantageously a SPRAGUE 2803 integrated circuit. The outputs of these relay drivers 102, 104 are transmitted along lines 106, 108, respectively to relay coils 110 and 112. These relay coils 110, 112 are connected to a 14 volt power source by means of line(s) 114 and are used to activate their associated relay contacts K1, K2 in the following manner.

The timer portion of unit 84 is set by means of line 116 connected to the input side of unit 84 and to a series of dipswitches 118, 120, 122 and 124. The timer setting can be varied from 15 seconds to a period of 15 minutes, as shown in TABLE 126 schematically indicated in FIG. 5. Appropriate settings of the various dip switches 118–124 allows for these various timer settings and, together with the timer portion of unit 84, are used to open and close the relay contacts K1, K2 as desired. In particular, relay contact K2 closes and relay contact K1 opens when the first signal representative of the steam temperature at the source is less than the header setpoint temperature $T_{HDR}$, or when the difference in steam temperature between the source and drain, $\Delta T$, is greater than or equal to the setpoint steam temperature, $T_{SP}$. In particular, if the timer has timed out, and the temperature representative of the steam temperature at the source is greater than the header setpoint temperature $T_{HDR}$, or if the difference in temperature between the steam temperature at the source and steam temperature at the drain is less than the steam setpoint temperature, $T_{SP}$, relay contact K2 is opened and relay contact K1 is closed.

I claim:

1. A system for automatically controlling a modulating type drain valve connected to a steam piping system used to supply steam from a source to at least one sootblower, comprising:

means for producing a first signal representative of the steam temperature at the source;

means for producing a second signal representative of the steam temperature at the modulating type drain valve;

means, connected to said first and second signal producing means, for producing a third signal, based on said first and second signals, representative of the difference in steam temperature between the steam temperature at the source and the steam temperature at the modulating type drain valve;

means for providing a temperature setpoint signal;

a microprocessor based control unit connected to said means for producing said first and second signals, and having means connected to said third signal producing means and to said temperature setpoint signal providing means for producing a drain valve control signal as a function of said third signal for proportionally controlling drain valve position to control a rate of flow through said modulating type drain valve based upon a comparison of said third signal to said temperature setpoint signal, said setpoint signal being representative of the minimum allowable difference in steam temperature between the steam temperature at the source and the steam temperature at the modulating type drain valve; and means for providing said drain valve control signal to means for controlling said modulating type drain valve in response to said drain valve control signal, said control means proportionally closing said drain valve when the value of said third signal is less than the value of said setpoint signal and proportionally opening said drain valve when the value of said third signal is greater than or equal to the value of said setpoint signal.

2. A system for automatically controlling a drain valve connected to a steam piping system used to supply steam from a source to at least one sootblower, comprising:

means for producing a first signal representative of the steam temperature at the source;

means for producing a second signal representative of the steam temperature at the drain valve;

means, connected to said first and second signal producing means, for producing a third signal, based on said first and second signals, representative of the difference in steam temperature between the steam temperature at the source and the steam temperature at the drain valve;

means for providing a temperature setpoint signal;

a microprocessor based control unit connected to said means for producing said first and second signals having a first summing amplifier connected at its inputs to said first and second signal producing means, and having means connected to said third signal producing means and to said temperature setpoint signal providing means for producing a drain valve control signal based upon a comparison of said third signal to said temperature setpoint signal, said setpoint signal being representative of the minimum allowable difference in steam temperature between the steam temperature at the source and the steam temperature at the drain valve, said microprocessor based control unit also including timer means for selecting how long the drain valve is to remain open once the drain valve has been signaled to open; and means for providing said drain valve control signal to means for controlling said drain valve in response to said drain valve control signal, said control means closing said drain valve when the value of said third signal is less than the value of said setpoint signal and opening said drain valve when the value of said third signal is greater than or equal to the value of said setpoint signal.

* * * * *